US011313556B2

(12) United States Patent
Zanichelli et al.

(10) Patent No.: US 11,313,556 B2
(45) Date of Patent: Apr. 26, 2022

(54) BURNER FOR THE PRODUCTION OF SYNTHESIS GAS AND RELATED COOLING CIRCUIT

(71) Applicant: Casale SA, Lugano (CH)

(72) Inventors: Luca Zanichelli, Milan (IT); Elio Strepparola, Bedero Valcuvia (IT); Marco Carlucci Mazzamuto, Appiano Gentile (IT)

(73) Assignee: Casale SA, Lugano (CH)

( * ) Notice: Subject to any disclaimer, the term of this patent is extended or adjusted under 35 U.S.C. 154(b) by 0 days.

(21) Appl. No.: 15/548,904

(22) PCT Filed: Feb. 2, 2016

(86) PCT No.: PCT/EP2016/052134
§ 371 (c)(1),
(2) Date: Aug. 4, 2017

(87) PCT Pub. No.: WO2016/124567
PCT Pub. Date: Aug. 11, 2016

(65) Prior Publication Data

US 2018/0031231 A1 Feb. 1, 2018

(30) Foreign Application Priority Data

Feb. 5, 2015 (EP) ..... 15153915

(51) Int. Cl.
*F23D 14/78* (2006.01)
*F23D 14/22* (2006.01)

(52) U.S. Cl.
CPC ..... *F23D 14/78* (2013.01); *F23D 14/22* (2013.01); *F23D 2206/00* (2013.01)

(58) Field of Classification Search
CPC ..... F23D 14/22; F23D 14/78; F23D 2214/00; F23D 11/36
See application file for complete search history.

(56) References Cited

U.S. PATENT DOCUMENTS 2,331,989 A * 10/1943 Luellen ..... F23D 17/002 122/6.5
2,442,062 A * 5/1948 Solem ..... F23D 14/78 122/6 R (Continued)

FOREIGN PATENT DOCUMENTS

CN 1101113 A 4/1995
CN 101392189 A 3/2009

(Continued)

OTHER PUBLICATIONS

English abstract of JP360091127A attached as "JP360091127A_english_abstract.pdf" (Year: 1985).*

(Continued)

*Primary Examiner* — Vivek K Shirsat
*Assistant Examiner* — Ko-Wei Lin
(74) *Attorney, Agent, or Firm* — Akerman LLP

(57) ABSTRACT

A burner system (100) for the combustion of a hydrocarbon feedstock with an oxidant, comprising at least one burner (1) and a cooling circuit (2), where in: the burner system (100) comprises a fuel side (3, 15) and an oxidant side (4, 14); the burner (1) comprises a cooling chamber (5) connected to said cooling circuit(2); said cooling circuit (2) comprises a reservoir tank(8) for said cooling fluid and a circulation pump(16); said system (100) comprises pressure equalizing line (15*b*) arranged to establish a fluid communication between the inside of said reservoir tank (8) and at least one of said fuel side and oxidant side.

7 Claims, 1 Drawing Sheet

(56) References Cited

U.S. PATENT DOCUMENTS 2,542,194 A 2/1951 Hannum
2,546,937 A * 3/1951 Wyandt ..... C21C 5/4613 239/128
2,794,681 A * 6/1957 Theodor ..... C21C 5/4606 239/71
2,850,325 A * 9/1958 Theodor ..... F23D 14/78 239/71
2,981,250 A * 4/1961 Stewart ..... F24H 1/107 122/17.2
3,121,457 A * 2/1964 Whipple ..... F23D 14/78 239/132.3
3,170,781 A * 2/1965 Keefer ..... C03B 5/2356 65/159
3,202,200 A * 8/1965 Marshall ..... F23D 14/78 122/6.5
3,693,875 A 9/1972 Shepard
3,743,606 A * 7/1973 Marion et al. ..... C01B 3/363 252/373
3,847,564 A * 11/1974 Marion ..... C01B 3/363 252/373
3,861,859 A 1/1975 Sherwood
4,089,639 A * 5/1978 Reed ..... F23L 7/005 431/11
4,358,266 A * 11/1982 Pont ..... F23D 11/10 239/412
4,743,194 A 5/1988 Stellaccio
4,999,029 A * 3/1991 Lueth ..... C01B 3/363 252/373
5,261,602 A * 11/1993 Brent ..... C01B 3/363 110/347
6,012,915 A * 1/2000 Mori ..... F23D 91/02 431/278
6,698,207 B1 * 3/2004 Wiebe ..... F23D 14/78 60/737
6,814,568 B2 11/2004 McEvoy et al.
6,923,001 B2 * 8/2005 Laster ..... F23R 3/40 431/170
7,690,203 B2 * 4/2010 Bland ..... F02C 7/222 60/737
7,785,491 B2 * 8/2010 Bedetti ..... C01B 3/363 252/373
8,070,484 B2 * 12/2011 Just ..... F23D 1/00 431/12
8,302,544 B2 11/2012 Takashima et al.
8,408,197 B2 * 4/2013 Cowles ..... F23C 3/004 126/360.1
8,899,224 B2 * 12/2014 Cowles ..... F23C 3/004 126/360.1
9,221,704 B2 * 12/2015 D'Agostini ..... F23D 14/66
9,481,839 B2 * 11/2016 Guo ..... C10J 3/506
9,777,922 B2 * 10/2017 Hegde ..... C03B 5/2356
10,041,666 B2 * 8/2018 Luka ..... F23C 3/004
2004/0045295 A1 * 3/2004 Wiebe ..... F23D 14/78 60/737
2004/0191708 A1 * 9/2004 Matoba ..... B01F 25/422 431/11
2005/0048333 A1 * 3/2005 Pettit ..... H01M 8/0258 422/600
2005/0281736 A1 * 12/2005 Bedetti ..... C01B 3/363 423/651
2009/0061372 A1 * 3/2009 Just ..... F23D 1/00 431/284
2010/0089383 A1 * 4/2010 Cowles ..... F23C 3/004 126/360.1
2010/0199939 A1 * 8/2010 Cottell ..... F17D 1/17 137/565.17
2011/0009627 A1 * 1/2011 Schmidtke ..... B01J 8/067 422/240
2012/0135360 A1 5/2012 Hannum et al.
2013/0112772 A1 * 5/2013 Kishore ..... F23D 11/40 239/132.3
2013/0122442 A1 * 5/2013 D'Agostini ..... F23D 14/66 432/13
2013/0220300 A1 * 8/2013 Cowles ..... F23C 3/004 126/360.1
2014/0138459 A1 * 5/2014 Pan ..... F23D 14/78 239/132.3
2015/0218470 A1 * 8/2015 Guo ..... C01B 3/363 60/781
2016/0076764 A1 * 3/2016 Hegde ..... F23D 14/78 65/134.4
2016/0130168 A1 * 5/2016 Cowles ..... C03B 5/2356 65/346
2017/0059154 A1 * 3/2017 Luka ..... F23C 3/004

FOREIGN PATENT DOCUMENTS

CN 102134520 A 7/2011
CN 102425794 A 4/2012
CN 203364135 U 12/2013
EP 0545281 A1 6/1993
EP 0997433 A1 5/2000
JP 60091127 A * 5/1985 ..... F23D 14/22
MX PA02010663 A 6/2003
WO 2014/193390 A1 12/2014

OTHER PUBLICATIONS

International Search Report issued in connection with PCT/EP2016/052134.
International Preliminary Report on Patentability issued in connection with PCT/EP2016/052134.

* cited by examiner

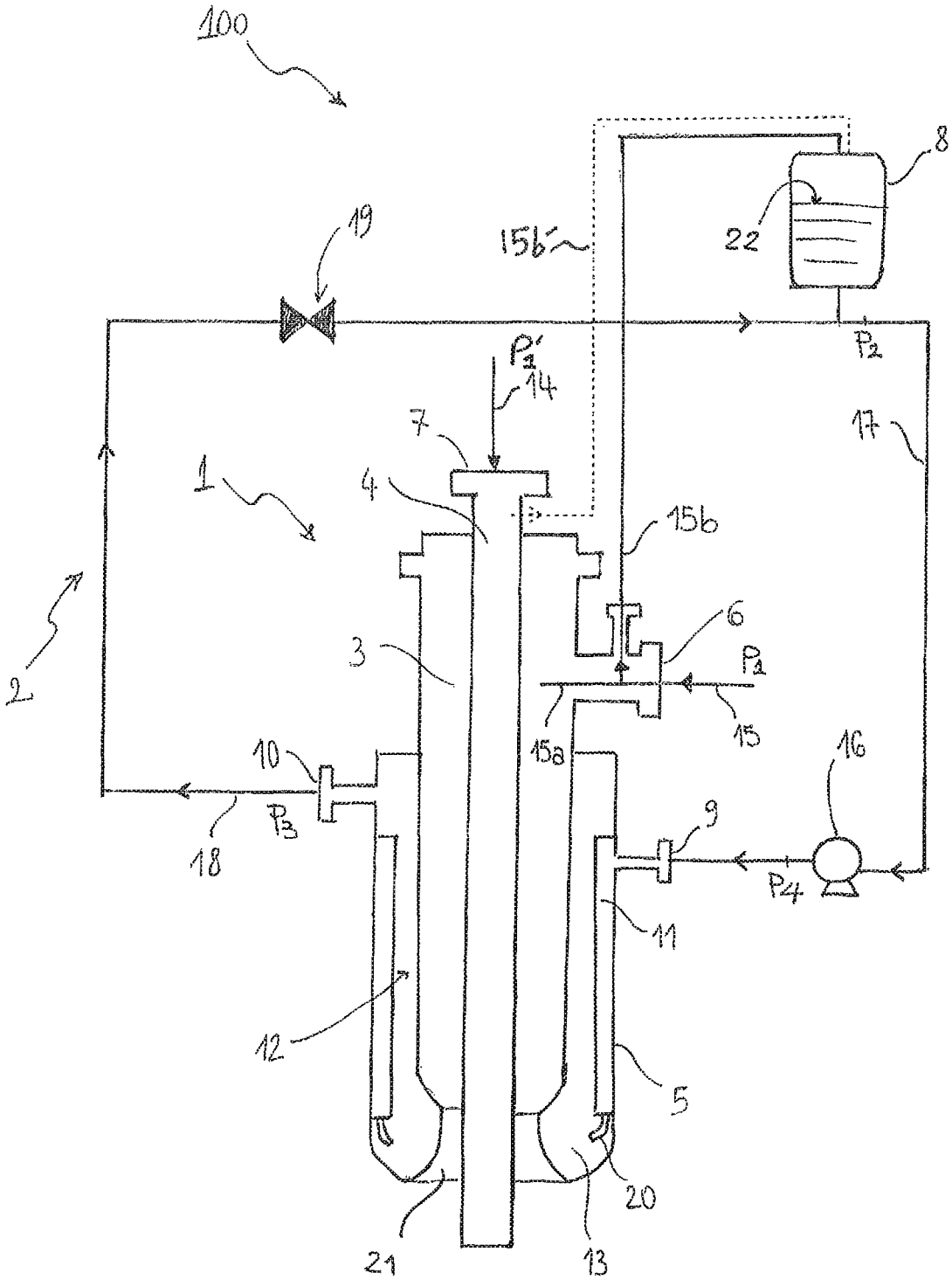
100
8
22
19
15b'
P2
P1'
14
7
17
1
4
15b
6
3
P1
2
15
15a
10
16
P3
9
18
P4
11
12
5
20
21
13

BURNER FOR THE PRODUCTION OF SYNTHESIS GAS AND RELATED COOLING CIRCUIT

This application is a national phase of PCT/EP2016/052134, filed Feb. 2, 2016, and claims priority to EP 15153915.2, filed Feb. 5, 2015, the entire contents of both of which are hereby incorporated by reference.

DESCRIPTION

Field of the Invention

The invention relates to a burner for the production of synthesis gas. In particular, the invention relates to a burner comprising a cooling circuit and a method of pressurization thereof.

Prior Art

Synthesis gas essentially comprising carbon monoxide and hydrogen is important for the industrial production of several chemicals, for example methanol, ammonia and synthetic fuels.

The production of said synthesis gas generally involves the combustion of a hydrocarbon source (e.g. natural gas) with an oxidant which can be air or enriched air or pure oxygen. Said combustion is typically performed in the presence of stoichiometric excess of the hydrocarbon source and in defect of the oxidant.

Common techniques for the above combustion include auto-thermal reforming (ATR) and partial oxidation (POX). They are carried out in reactors provided with a burner, which typically comprises a nozzle for the formation of a diffusion flame within a combustion chamber.

In particular, ATR is performed in the presence of a catalytic bed, which is situated below the combustion chamber, and temperatures typically in the range 950-1050° C. at reactor outlet, and around 1200° C. at catalyst inlet. POX is performed at even higher temperatures (1300-1700° C. at the reactor outlet) without a catalyst. Both ATR and POX are performed at high pressure, for example in the range 40-100 bar.

Thus, the burner of a ATR or POX reactor for the production of synthesis gas is subjected to harsh operating conditions. In order to cope with such high temperatures, the burner is made of high temperature metal alloys (e.g. Ni-Cr-Fe alloys) and is provided with a double-walled structure allowing the circulation of a cooling fluid inside the nozzle. Generally the cooling fluid is water. In particular, fluid cooling is necessary for the nozzle tip which is directly exposed to the combustion flames.

It is desirable to keep the cooling fluid under a pressure greater than the operating pressure of the burner (that is the pressure of the fuel, oxidant and product gas of the combustion) so as to prevent a contamination of the cooling circuit which would result in a reduced cooling and risk of failure of the burner.

Hence, a fluid-cooled nozzle can be regarded as a hollow body with one side exposed to the pressure of a process gas, and another side exposed to the greater pressure of the cooling fluid. Hence, the nozzle is stressed by a difference between the pressure of the process gas and the pressure of the cooling fluid.

During normal operation said difference is limited (e.g. some bars) which means that pressure of the process gas is substantially balanced by the pressure of the cooling fluid.

During transients such as start-up and shutdown, however, the pressure of the process gas is much lower, typically close to atmospheric, which means that the burner has to withstand substantially the full pressure of the cooling fluid.

The current solution to this problem is to design the burner with thick walls, typically in the range 15 to 25 mm, especially in the tip area. However increasing the thickness reduces effectiveness of cooling of the burner surfaces exposed to the flame. In fact, the thicker the wall, the higher the temperature of the surface exposed to the flame. In addition, a thicked-wall burner is more sensitive to alternate cycles of thermal stress, resulting in a greater risk of fatigue failure and shorter life of the burner.

Due to the above drawbacks, the prior art fluid-cooled burners for ATR and POX applications are still subjected to failures despite the use of expensive high temperature metal alloys. On the other hand, the active cooling is necessary as a non-cooled burner with metallic tips would rapidly undergo local fusion or creep and failure.

An air-cooled burner pipe is disclosed in U.S. Pat. No. 3,861,859.

SUMMARY OF THE INVENTION

The aim of the invention is to avoid the above drawbacks of the prior art. The invention aims to achieve a longer life and a reduced risk of failure of a double-walled burner cooled by a fluid under a high pressure. More in detail, the invention aims to solve the problem of stress induced by the relevant pressure difference between the process gas and the cooling fluid during transients, when the pressure of the process gas is low.

These aims are reached with a burner system and a method for pressurizing a cooling circuit of a burner system according to the claims.

A burner system according to the invention comprises at least one burner body and a cooling circuit, wherein:

the burner system comprises a fuel side and an oxidant side;

the burner body comprises a cooling chamber connected to said cooling circuit) for the passage of a cooling fluid;

said cooling circuit comprises a reservoir tank for said cooling fluid and a circulation pump;

said system comprises pressure equalizing means adapted to equalize the pressure inside said cooling circuit to the pressure of at least one of said fuel side and oxidant side, said means including at least one pressure equalizing line arranged to establish a fluid communication between the inside of said reservoir tank and at least one of said fuel side and oxidant side.

In a preferred embodiment, said pressure equalizing line provides a fluid communication of said fuel side and/or said oxidant side with a region of the reservoir tank above a liquid level of the cooling medium. As a consequence, the pressure of said line is transferred to a free surface of the cooling medium (for example water) contained in the reservoir tank. More preferably, the liquid cooling medium contained in the reservoir tank acts as a seal between the pressure equalizing line, which is in communication with the fuel side or oxidant side, and the cooling circuit. Accordingly, a mass transfer (e.g. a leakage of fuel) from the pressure equalizing line into any part of the cooling circuit other than the reservoir tank is prevented.

In a preferred embodiment, the burner body comprises a fuel duct and an oxidant duct and said pressure equalizing line provides a fluid communication directly between one of said ducts and said reservoir tank. Preferably the communication is made with the fuel side, which means that the fuel inlet pressurizes the reservoir tank.

According to yet another embodiment, the cooling circuit comprises at least one valve, orifice or other item, suitable to introduce a concentrated pressure drop of the cooling fluid between a cooling fluid outlet from the cooling chamber and said reservoir tank, and the magnitude of said concentrated pressure drop is such that, in operation, the pressure of the cooling fluid in the cooling circuit is greater than the gas pressure of said fuel side and oxidant side.

The main advantage of the invention is that the pressure of the fluid circulating in the cooling circuit is governed by the pressure of a process gas, for example of the fuel. Hence, the cooling circuit will follow the pressure transients of the burner, such as startups and shutdowns, without stressing the burner with a large pressure difference. This is a great advantage compared to the prior art systems where pressure of the cooling circuit is substantially constant regardless of the operating condition.

Another advantage is that the system of the invention can ensure that the pressure of the cooling circuit, and especially of the cooling chamber, is always greater than the pressure of fuel and oxidant, thus avoiding the risk of a contamination. This is achieved by the concentrated pressure drop which is located between the reservoir tank and the fluid outlet, so to determine a desired (sufficiently high) value of the pressure at the fluid outlet.

As a consequence, the invention allows minimize the thickness of the walls of the burner, with a considerable advantage in terms of lower temperature gradient, reduced thermal stresses and a more effective cooling, increasing life and safety in operation. Said advantage is of particular importance for the surfaces facing the combustion chamber and directly exposed to hot temperature and radiation from the chamber.

The advantages will emerge even more clearly with the aid of the detailed description below, relating to a preferred embodiment.

BRIEF DESCRIPTION OF THE DRAWINGS

FIG. 1 shows a sectional view of a process burner and a scheme of a related cooling system, according to an embodiment of the invention.

DETAILED DESCRIPTION

FIG. 1 shows a burner system 100 suitable for use in an ATR or in a POX reactor. Said burner system 100 is generally located at the upper end of said ATR or POX reactor, and is positioned above a combustion chamber (not shown in the FIGURE).

The burner system 100 comprises a burner body 1 and a cooling circuit 2.

The burner body 1 comprises coaxial outer duct 3 and inner duct 4 connected to a hydrocarbon fuel inlet 6 and to an oxidant inlet 7, respectively. The burner body 1 also comprises a cooling chamber 5 connected to the cooling circuit 2 for circulating a cooling fluid, such as water, around the walls of said fuel duct 3 and oxidant duct 4.

The fuel duct 3 and the oxidant duct 4 emerge into said combustion chamber. In operation, the end surfaces of the body 1, such as the surface 21, face directly the combustion chamber.

The cooling chamber 5 surrounds the outer surface of the fuel duct 3, and is provided with a cooling fluid inlet opening 9 and a cooling fluid outlet opening 10 which are connected to the cooling circuit 2.

The burner body 1 has a gas side subjected to a gas pressure (namely the inside of ducts 3, 4); combustion chamber-facing parts and surfaces, such as the surface 21, and a water side subjected to the pressure of water (or any other cooling fluid) in the circuit 2.

FIG. 1 shows a preferred embodiment where the cooling chamber 5 comprises an outer jacket 11 and an inner jacket 12. The inner jacket 12 is in contact with the fuel duct 3. The outer jacket 11 is in fluid communication with the cooling fluid inlet 9 and the inner jacket 12, instead, is in fluid communication with the cooling fluid outlet opening 10. The two jackets 11 and 12 are in communication via a conduit 20 and a connecting chamber 13 at the tip region of the burner body 1.

The cooling circuit 2 comprises essentially a reservoir tank 8 for the storage of said cooling fluid, a circulation pump 16 and a valve 19. The valve 19 is designed to introduce a selected pressure drop on the circuit 2, and said valve is preferably located in the portion of said circuit 2 between the cooling fluid outlet 10 and the reservoir tank 8. The pump 16 is preferably located in the portion between said tank 8 and the inlet 9.

The pressure drop of the valve 19 ensures that the pressure of the cooling fluid is always greater than the pressure of the process gas of the burner, namely of fuel and oxidizer, as will be explained below in a greater detail. In equivalent embodiments, the valve 19 may be replaced by a suitable orifice or by one or more items suitable to introduce the same pressure drop.

The operation is as follows.

A gaseous fuel 15 such as natural gas is introduced into the fuel duct 3 via the inlet opening 6 and a suitable oxidant 14 is introduced into the oxidant duct 4 via the inlet opening 7. Said oxidant 14 is preferably air, enriched air or oxygen. The fuel inlet 6 is in communication with the reservoir tank 8 via a duct 15*b*, in such a way that the fuel inlet pressure $P_1$ is transmitted to the cooling fluid contained in said tank 8. Hence, the duct 15*b* acts as a pressure equalizing line of the reservoir tank 8. The gas fuel 15 enters the fuel duct 3 at 15*a*, as illustrated.

It can be noted that the pressure equalizing duct 15*b* enters the reservoir tank 8 above the free surface 22 of the cooling fluid, under operation. The pressure P1 is then transmitted to said free surface 22 while the cooling fluid itself isolates the duct 15*b*, which is part of the fuel side, from the cooling fluid line 17. The duct 15*b* acts only as a pressure equalizing line, by pressurizing the inside of the tank 8; no fuel contaminates the cooling circuit 2 thanks to said sealing effect.

The cooling fluid, such as water, is circulated by the pump 16, enters the cooling chamber 5 via the inlet 9, traverses the jackets 11 and 12 and leaves the body 1 via the outlet 10. The circulation pump 16 compensates for the pressure losses through the circuit 2 and the cooling chamber 5.

The connection between the fuel gas inlet 15 and the reservoir tank 8, via duct 15*b*, determines a pressure $P_2$ of the cooling fluid at the outlet of the tank 8 (namely the suction pressure of the pump 16) substantially equal to the fuel inlet pressure $P_1$.

The pressure P3 of the cooling fluid at the outlet 10 of the chamber 5 can be expressed as:

$$P_3=P_1+\Delta P_0+\Delta P_1$$

wherein $\Delta P_0$ is the pressure drop across the valve 19 and $\Delta P_1$ includes the distributed pressure loss of the circuit. Generally $\Delta P_0$ is significantly greater than $\Delta P_1$ which means that the outlet pressure $P_3$ is determined by the pressure loss of the valve 19.

Accordingly, the delivery pressure $P_4$ of the pump 16 is determined as $P_3$ plus the pressure loss through the cooling chamber 5.

By means of an appropriate choice of the pressure loss $\Delta P_0$ introduced with the valve 19, said pressure loss $\Delta P_0$ being above a threshold value, it is ensured that the pressure in the circuit 2 is always above the pressure $P_1$, in particular the pressure in the water circuit is greater than $P_1$ by a certain amount which is dictated by the choice of $\Delta P_0$.

Hence the invention provides that the pressure in the cooling circuit 2 is always above the pressure in the gas side of the burner, avoiding the risk of gas (e.g. fuel or oxidizer or mixture thereof) entering the circuit 2 in case of a seal leakage. In particular, $\Delta P_0$ shall be greater than the pressure loss in the cooling chamber 5. At the same time, the pressure of the cooling circuit 2 is governed by the pressurization of the reservoir tank 8 by means of the line 15*b*, which means that the pressure of the cooling fluid follows the gas pressure during transients. Accordingly, the walls of the burner body 1 are not stressed by excessive water pressure when the gas pressure inside drops. The present invention thus achieves the aims set out above.

A related advantage is that an embodiment with a reduced wall thickness is possible, which reduces the thermal inertia. Reducing the thermal inertia is beneficial in particular for surfaces such as the surface 21 facing the combustion chamber and exposed to a high thermal stress.

FIG. 1 illustrates a single-body embodiment of the burner. The invention is also applicable to multi-body burner systems including several burner bodies (e.g. for POX).

In a multi-body embodiment, the burner bodies are preferably connected to a common cooling circuit 2. In this case, the cooling fluid is circulated by the pump 16 and is split into a number of streams, each one being independently fed to a respective burner body 1 via a corresponding inlet 9 and leaving the body itself via a corresponding outlet 10.

The invention claimed is:

1. A burner system for the combustion of a hydrocarbon feedstock with an oxidant, comprising at least one burner body and a cooling circuit, wherein:

the burner system comprises a fuel side and an oxidant side;

the at least one burner body comprises a cooling chamber connected to said cooling circuit for the passage of a cooling fluid;

wherein:

said cooling circuit comprises a reservoir tank for said cooling fluid and a circulation pump;

said burner system comprises pressure equalizing means adapted to equalize the pressure inside said cooling circuit to the pressure of at least one of said fuel side and oxidant side, said means including at least one pressure equalizing line arranged to establish a fluid communication between the inside of said reservoir tank and said fuel side, wherein said cooling circuit is configured to provide said cooling fluid to said at least one burner body while said at least one burner body combusts said hydrocarbon feedstock with said oxidant.

2. The burner system according to claim 1, wherein said at least one pressure equalizing line is arranged to provide a fluid communication of said fuel side with a region of the reservoir tank which is above a liquid level of the cooling fluid, so that the pressure of said at least one pressure equalizing line is transferred to a free surface of the cooling fluid contained in the reservoir tank.

3. The burner system according to claim 2, wherein the cooling fluid contained in the reservoir tank acts as a seal against a mass transfer from said at least one pressure equalizing line into any part of the cooling circuit other than the reservoir tank.

4. The burner system according to claim 1, wherein said at least one burner body comprises a fuel duct, and said at least one pressure equalizing line provides a fluid communication directly between said fuel duct, and said reservoir tank.

5. The burner system according to claim 1, said at least one pressure equalizing line being arranged to connect the reservoir tank with a fuel inlet.

6. The burner system according to claim 1, wherein the cooling circuit also comprises at least one item suitable to introduce a concentrated pressure drop of the cooling fluid between a cooling fluid outlet from the cooling chamber and said reservoir tank, and the magnitude of said concentrated pressure drop is such that, in operation, the pressure of the cooling fluid in the cooling circuit is greater than the gas pressure of said fuel side.

7. The burner system according to claim 6, wherein said item is either a valve or an orifice.

* * * * *